United States Patent [19]

Kozacka et al.

[11] 3,997,862

[45] Dec. 14, 1976

[54] LABELLED HIGH-VOLTAGE FUSE

[75] Inventors: Frederick J. Kozacka, South Hampton, N.H.; Erwin Salzer, Waban, Mass.

[73] Assignee: The Chase-Shawmut Company, Newburyport, Mass.

[22] Filed: June 6, 1975

[21] Appl. No.: 584,394

Related U.S. Application Data

[63] Continuation of Ser. No. 390,019, Aug. 20, 1973, abandoned.

[52] U.S. Cl. ..... 337/241; 337/158

[51] Int. Cl.[2] ..... H01H 85/30

[58] Field of Search ..... 337/158, 159, 160, 161, 337/162, 241, 293; 40/2 R

[56] References Cited

UNITED STATES PATENTS

| | | | |
|---|---|---|---|
| 3,611,239 | 10/1971 | Kozacka | 337/293 |
| 3,843,948 | 10/1974 | Kozacka | 337/158 |
| 3,881,161 | 4/1975 | Kozacka | 337/159 |

*Primary Examiner*—Harold Broome
*Attorney, Agent, or Firm*—Erwin Salzer

[57] ABSTRACT

A high-voltage fuse having a pair of axially spaced paper labels at the relatively cool ends thereof remote from the plateau-like high temperature zone formed by the fuse when carrying current.

2 Claims, 4 Drawing Figures

T
F
1
2
3
4
5
6
7
8
9

LABELLED HIGH-VOLTAGE FUSE

This is a continuation of application Ser. No 390,019, filed Aug. 20, 1973 now abandoned.

BACKGROUND OF THE INVENTION

This invention relates to labelling of high-voltage fuses. The labelling of low voltage fuses, i.e. fuses having a voltage rating up to 600 volts does not present any particular difficulties and this is also true in regard to fuses having a voltage rating up to a few kv. The length of fuse tubes increases as the rated voltage of fuses increases and under such conditions the temperature rise of fuse tubes may be so high as to call for heat resistant labelling means for providing fuse tubes with the required information as to the origin of the product, its rating, etc.

Low voltage fuses are relatively short and there is an intense axial heat flow in such fuses. As a result of this fact, the temperature distribution along the fuse tube of a low voltage fuse is substantially in the shape of a parabola having its peak in the transverse median plane of the fuse and its lowest value adjacent the terminals of the fuse. Because of the intense axial heat flow the highest temperatures at the outside of the fuse tube are moderate. This makes it readily possible to label such fuses with labels of a non-heat resistant material, e.g. ordinary paper.

The situation is very different in high-voltage fuses, e.g. fuses having a voltage rating of 15 kv, and higher. In such fuses the length of the fuse tube results when the fuse is carrying current in a plateau-like zone of relatively high temperature between the ends of the fuse tube. The level of this plateau-like zone of relatively high temperature may be considerably higher than the peak temperatures found on the casings of relatively short low voltage fuses. As a result, high-voltage fuses cannot properly be labelled in the same fashion as low voltage fuses. As a general rule, the fuse tubes of high voltage fuses are imprinted with a heat resistant ink. This process is costly when it comes to processing large numbers of high-voltage fuses formed of many groups of which each group calls for an imprint of a different kind.

The present invention contemplates the use of labels of a non-temperature resistant material, e.g. paper, on high-voltage fuses.

SUMMARY OF THE INVENTION

This invention refers to high-voltage fuses including an insulating fuse tube and a pair of terminal plugs plugging the ends of said fuse tube and held in position by steel pins projecting transversely through the fuse tube into said pair of plugs. The fuses include a pulverulent arc-quenching filler inside the fuse tube and fusible element means conductively interconnecting the pair of terminal plugs and submersed in said arc-quenching filler. The fuse tube has such a length as to result in a plateau-like zone of relatively high temperature between the ends of the fuse tube when the fuse is carrying current.

The improvement according to this invention comprises a pair of axially spaced band labels of a non-temperature resistant material adhesively affixed to the fuse tube outside said plateau-like zone of relatively high temperature each immediately adjacent to one of the ends of the fuse tube where the temperature of the fuse tube is relatively low, said pair of band labels leaving said plateau-like zone of relatively high temperature of said fuse tube uncovered, and each of said pair of band labels covering the radially outer ends of said steel pins of one of said pair of plugs.

DESCRIPTION OF PREFERRED EMBODIMENT

Figures 1, 2, 3, 4:
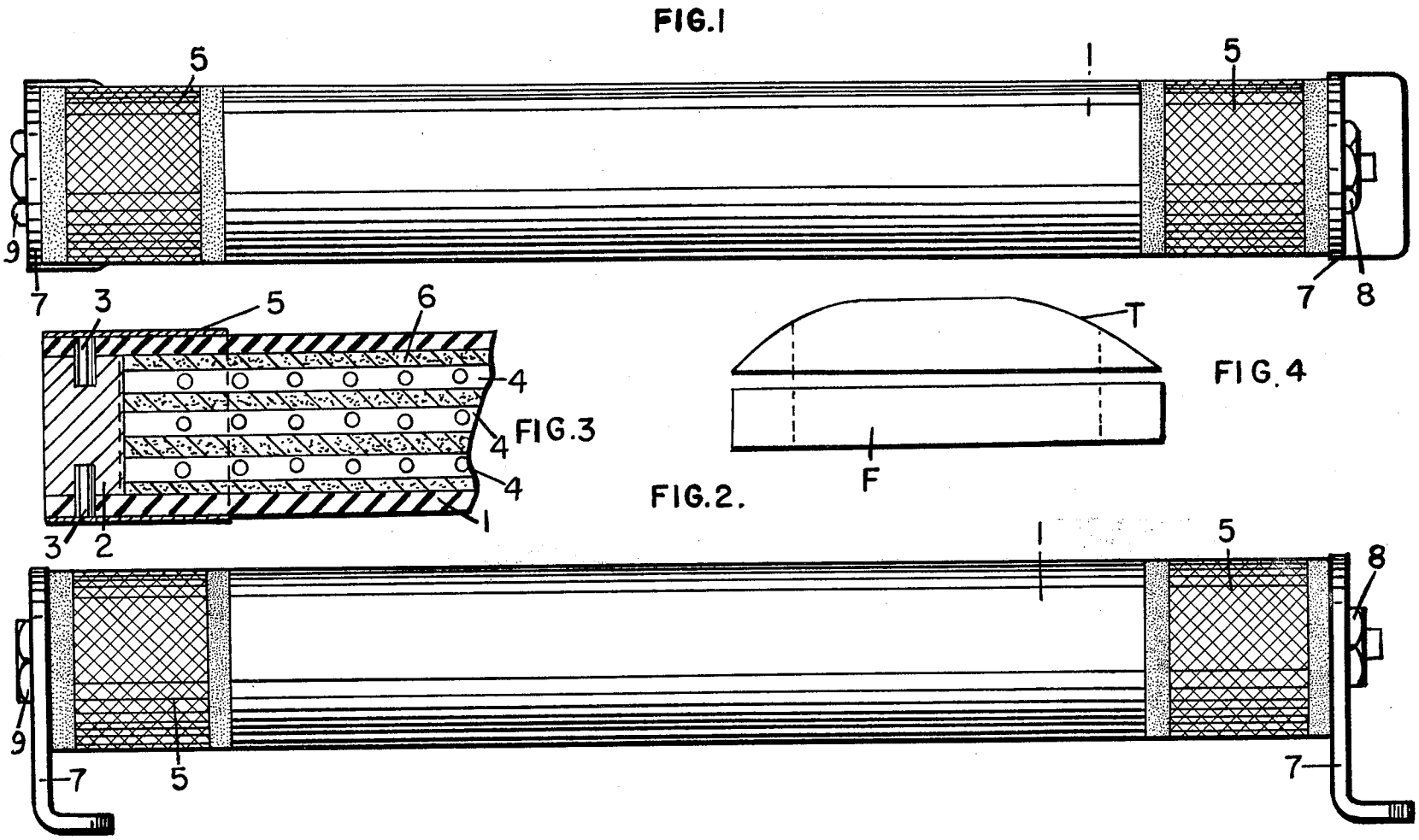
FIG. 1 is a top-plan view of a high-voltage fuse embodying this invention.
FIG. 2 is a side elevation of the structure shown in FIG. 1.
FIG. 3 is a longitudinal section of the left end of the fuse structure of FIG. 1.
FIG. 4 is a diagrammatic representation of temperature distribution along a high-voltage fuse.

Referring now to the drawings, numeral 1 has been applied to indicate a fuse tube of insulating material, e.g. melamine-glass-cloth. Both ends of fuse tube 1 are closed by terminal plugs 2 maintained in position by steel pins 3 projecting transversely through fuse tube 1 into terminal plugs 2. FIG. 3 shows the left end of the structure of FIGS. 1 and 2 and the right end may be substantially the same as the left end. Reference numeral 6 has been applied to indicate a pulverulent arc-quenching filler, e.g. quartz sand, inside of fuse tube 1. The terminal plugs 2 are conductively interconnected by fusible element means 4 formed by perforated silver ribbons. Silver ribbons 4 are submersed in pulverulent filler 6. The length of fuse tube 1 is such as to result in a plateau-like zone of relatively high temperature between the ends of fuse tube 1 when the fuse is carrying current. This has been shown in FIG. 4 wherein reference character F has been applied to generally indicate a high-voltage fuse and reference character T has been applied to indicate the temperature distribution along the fuse when the latter is carrying current. The dotted line in FIG. 4 indicates zones of relatively low temperature at both ends of the fuse where the highest temperature is substantially less than the level of the temperature plateau formed between the ends of the fuse structure. These zones of relatively low temperature are areas where labels of paper or like non-heat-resistant material may be affixed without danger of thermal destruction. These areas are relatively small when compared to the total surface of fuse tube 1, but if both ends of the fuse structure are provided with separate band labels 5 all information that is needed for properly identifying any particular fuse can be provided on the labels in reasonably large, easy to read print. As clearly shown in FIGS. 1–4 band labels 5 leave the plateau-like relatively high temperature zone of fuse tube 1 uncovered, and are confined to the low temperature zones of fuse tube 1. Each of band labels 5 covers the radially outer ends of the steel pins 3 of one of the pair of terminal plugs 2. Ferrules of metal often used for that purpose have been deleted in the interest of economy. Each band label 5 has a length sufficient to cover the entire periphery of fuse tube 1. In order to conveniently affix band labels 5 to casing 1 the former are provided with a pressure-sensitive adhesive.

The fuse is held in position and connected into an electric circuit by means of strap-like fuse holders 7 which engage under pressure the axially outer end surfaces of the pair of terminal plugs 2. Numeral 8 has been applied to indicate a blown fuse indicator in form of a plug-screw for attaching the right fuse holder strap 7 to the right plug terminal of the fuse. Such a blown fuse indicator has been disclosed in detail in U.S. Pat. No. 3,621,433 to Richard Belcher, Nov. 16, 1971 for ELECTRIC CARTRIDGE FUSE HAVING PLUG TERMINALS. Reference may be had to that patent for further information in regard to blown fuse indicator 8, as well as in regard to further information as to the internal configuration of the fuse structure but diagrammatically indicated in FIG. 3. Reference numeral 9 has been applied to indicate a hex screw projecting through the left fuse holder strap 7 into the left plug terminal 2. The internally screw threaded bore in left plug 2 for receiving screw 9 has not been shown in FIG. 3 since it is not an essential element as far as the present invention is concerned.

We claim as our invention:

1. A labelled high-voltage fuse including an insulating fuse tube, a pair of terminal plugs plugging the ends of said fuse tube and held in position by steel pins transversely projecting through said fuse tube into said pair of plugs; said fuse further including a pulverulent arc-quenching filler inside said fuse tube and fusible element means conductively interconnecting said pair of terminal plugs and submersed in said filler, said fuse tube having such a length as to result in a plateau-like zone of relatively high temperature between the ends of said fuse tube when said fuse is carrying current, wherein the improvement comprises a fuse tube unencumbered by the presence of a pair of metal furrules at the ends thereof and a pair of axially spaced band labels of a non-temperature resistant material adhesively affixed directly to said fuse tube at the regions normally occupied by a pair of ferrules outside said plateau-like zone of relatively high temperature and at points where the temperature of said fuse tube is relatively low when the fuse is carrying current, said pair of band labels being axially spaced from said plateau-like zone of relatively high temperature of said fuse tube, and each of said pair of band labels covering the radially outer ends of said steel pins of one of said pair of plugs.

2. A labelled high-voltage fuse including an insulating fuse tube, a pair of terminal plugs plugging the ends of said fuse tube and held in position by steel pins transversely projecting through said fuse tube into said pair of terminal plugs; said fuse further including a pulverulent arc-quenching filler inside said fuse tube and fusible element means conductively interconnecting said pair of terminal plugs and submersed in said filler, said fuse tube having such a length as to result in a plateau-like zone of relatively high temperature between the ends of said fuse tube when said fuse is carrying current, wherein the improvement comprises a pair of axially spaced band labels of non-temperature resistant material adhesively directly affixed to the axially outer regions of said fuse tube normally occupied by a pair of metallic ferrules in the absence of such a pair of ferrules, each of said pair of band labels having an axially outer edge substantially coextensive with one of the axially outer edges of said fuse tube covering the radially outer ends of said steel pins of one of said pair of terminal plugs and extending axially inwardly beyond the axially inner end surface of said one of said pair of terminal plugs but being axially spaced from said plateau-like zone of relatively high temperature.

* * * * *